US006030076A

United States Patent [19]

Yoshimura et al.

[11] Patent Number: 6,030,076

[45] Date of Patent: Feb. 29, 2000

[54] INK JET DYEING APPARATUS

[75] Inventors: Hisashi Yoshimura, Nara; Hajime Horinaka, Kashiba; Yoshinobu Okumura, Yamatokoriyama; Norihiro Ochi, Yamatokoriyama; Hiroshi Onda, Yamatokoriyama; Michihiro Yamashita, Tenri, all of Japan

[73] Assignee: Sharp Kabushiki Kaisha, Osaka, Japan

[21] Appl. No.: 08/990,078

[22] Filed: Dec. 12, 1997

[30] Foreign Application Priority Data

Dec. 13, 1996 [JP] Japan ..... 8-332579

[51] Int. Cl.[7] ..... B41J 3/407

[52] U.S. Cl. ..... 347/106; 347/4

[58] Field of Search ..... 347/106, 105, 347/2, 4, 110

[56] References Cited

FOREIGN PATENT DOCUMENTS 60-157867 8/1985 Japan .
63-85188 4/1988 Japan .
403059177 3/1991 Japan .
03113081 5/1991 Japan .
7-3667 1/1995 Japan .
407119046 5/1995 Japan .

*Primary Examiner*—Richard Moses

[57] ABSTRACT

Cloth is successively conveyed by a supply roller and a take up roller over a platen which opposes an ink jet head selectively jetting ink. The platen has an opening formed at a surface opposing to the ink jet head, and an air suction opening behind the opening of the platen is connected to an air suction unit through an air path. At the time of dyeing, fluff on the surface of the cloth opposing to the ink jet head is sucked and laid down on the surface of the cloth by air suction by the air suction unit, and ink is appropriately jetted to the surface of the cloth from the ink jet head. Therefore, ink jet is not hindered by the fluff on the surface of the cloth at the time of dyeing. Therefore, ink drops can reach the desired position on the surface of the cloth, and satisfactory dyeing without any distortion in patterns is performed.

20 Claims, 14 Drawing Sheets

*Fig. 8*

| CASE / SPEED OF INK EMISSION | CASE 1 OFFSET FORM TARGET POSITION WHEN DT=4mm | CASE 2 OFFSET FORM TARGET POSITION WHEN DT=3.5mm | CASE 3 OFFSET FORM TARGET POSITION WHEN DT=3mm | CASE 4 VARIATION IN OFFSET FROM TARGET POSITION WHEN △DT=1mm | CASE 5 VARIATION IN OFFSET FROM TARGET POSITION WHEN △DT=0.5mm |
|---|---|---|---|---|---|
| 8m/sec | 0.35278mm | 0.30868mm | 0.26458mm | 0.0882mm | 0.0441mm |
| 6m/sec | 0.47037mm | 0.41157mm | 0.35278mm | 0.1176mm | 0.0588mm |
| 4m/sec | 0.70556mm | 0.61736mm | 0.52917mm | 0.1764mm | 0.0882mm |

INK JET DYEING APPARATUS

BACKGROUND OF THE INVENTION

1. Field of the Invention

The present invention relates to an ink jet dyeing apparatus and, more specifically, to an ink jet dyeing apparatus for dyeing a desired pattern by jetting dyeing ink to cloth, utilizing ink jet method.

2. Description of the Background Art

Textile printing is one of representative conventional method of dyeing cloth. The method of textile printing has been improved variously and has attained considerably high technical level. However, this method requires planning, engraving and processing of the desired pattern, preparation of starch for textile dyeing, steps for preparing production and so on. After all these steps, dyeing of a desired pattern is possible for the first time. Accordingly, it takes large number of manufacturing steps and long time as well as high skill, resulting in high cost.

In view of the foregoing, a method of dyeing cloth using an ink jet type printer which allows formation of an image in a desired color by selectively jetting ink of the desired color to a sheet has been proposed and practically used. The ink jet type printer enabled dyeing of a desired pattern on the cloth in a simple manner without requiring high skill.

Recent development in fiber materials and advancement in knitting and weaving technique result in production of cloth with fluff, of which use has been widened expansively. When such cloth having fluff is to be dyed in a desired pattern using the aforementioned ink jet type printer, ink jetting may possibly be hindered by the fluff on the surface of the cloth, or the direction of ink jet may possibly be changed, whereby dyeing of the desired pattern fails.

More specifically, in an ink jet type printer, distance between an ink jet head jetting ink to the cloth is as short as 1 to 4 mm, and therefore the fluff may close the orifice for jetting ink of the ink jet head, or the fluff intercept the jetted ink. Therefore, dyeing of cloth having fluff is difficult. In view of this problem, Japanese Patent Laying-Open No. 7-3667 proposes a method of dyeing cloth having fluff utilizing ink jet type printer. According to this method of dyeing, first, an adhesive is applied to the fluff surface of the cloth, fluffs are made parallel in one direction to be laid down low on the surface of the cloth and adhered on the surface by the adhesive, and thereafter, dyeing is performed by the ink jet printer. Therefore, ink jet is not hindered by the fluff, and it becomes possible to dye the fluffed cloth in a desired pattern in a desired color. However, according to this method, a process for smoothing fluff on the surface of the cloth uniformly is necessary before dyeing. Thus, preprocessing for dyeing is much complicated, resulting in high cost. Further, after dyeing, when the adhesive on the surface of the cloth is removed to raise the fluff which have been adhered and laid down, dyed pattern may be damaged or color bleeding may be experienced as the adhesive is removed.

Japanese Patent Laying-Open No. 60-157867 discloses an ink jet dyeing apparatus provided with a suction housing for sucking cloth from the rear surface in a conveyor path for conveying cloth at the time of dyeing, in order to prevent offset or distortion of image on the surface of the cloth at the time of dyeing.

SUMMARY OF THE INVENTION

An object of the present invention is to provide an ink jet dyeing apparatus having a simple structure and eliminating necessity of preprocessing and post processing for dyeing, even in dyeing fluff cloth.

The above described object of the present invention is attained by an ink jet dyeing apparatus in which the cloth is conveyed with its surface positioned opposing to a head for jetting ink in accordance with the ink jet method, the dyeing apparatus having a fluff suppressing unit for suppressing fluff on the surface of the cloth by using wind pressure when the conveyed cloth is to be dyed by jetting ink to the surface of the cloth.

Accordingly, fluff on the surface of the cloth is suppressed by wind pressure at the time of dyeing, and therefore satisfactory dyeing of the cloth surface utilizing ink jet is possible, not affected by the fluff on the surface of the cloth. In this manner, an ink jet dyeing apparatus having a simple structure and allowing satisfactory dyeing without requiring any preprocessing or post processing for dyeing even when dyeing fluff cloth surface is obtained.

The aforementioned fluff suppressing unit includes an air suction unit for sucking air from the rear side of the cloth, so as to attain negative pressure at the rear surface side of the cloth opposing to the head. Consequently, the air at the surface of the cloth is sucked in through the cloth, and hence fluffs on the surface of the cloth facing the head is laid down to be in close contact with the surface of the cloth. Therefore ink jet is not hindered by the fluff and satisfactory dyeing is possible in a simple manner when the cloth surface is to be dyed.

The aforementioned fluff suppressing unit has a hollow platen having an opening to be in contact with the rear surface of the cloth opposing to the head, and the air suction unit is connected to the platen through an air flow path sucked by the air suction unit. Accordingly, the cloth is dyed while it is conveyed covering the opening of the platen, which ensures higher effect of air suction and further suppresses the influence of fluff in dyeing. The aforementioned fluff suppressing unit further includes a recess formation suppressing unit for suppressing formation of a recess at the surface of the cloth at the opening of the platen when air is sucked by the air suction unit. Accordingly, the surface of the cloth is prevented from being sucked inside the hollow platen through the opening with the surface of the cloth curved considerably inward by suction of air by the air suction unit. Thus, the recess formation suppressing unit makes constant the distance between the surface of the cloth and the head. Accordingly, even when air suction by the air suction unit is being performed, the ink can surely be jet out and reach the desired position on the surface of the cloth, and hence distortion of the pattern in dyeing can be prevented.

For conveying the cloth, the ink jet dyeing apparatus further includes a supply roller for supplying the cloth to a position facing the head, and a take up roller for taking the cloth away from the position facing the head. The recess formation suppressing unit allows conveying of cloth by the supply roller and the take up roller stretching tight the cloth, while the cloth facing the head has its rear surface being in contact with the opening of the platen. Therefore, the recess formation suppressing unit can be provided utilizing the supply roller and the take up roller provided for conveying the cloth, and therefore additional parts for the recess formation suppressing unit are not required. Therefore, scale of the apparatus is not enlarged, and the cost is not increased.

The recess formation suppressing unit has a mesh allowing passage of air, covering the opening of the platen. The mesh prevents the cloth from entering the hollow platen from the opening by air suction with the surface of the cloth curved considerably, so that it becomes possible to surely jet and direct ink to the desired position on the surface of the cloth and to dye the cloth in a desired pattern.

The area of each opening of the mesh is at most 25 $cm^2$.

When a plurality of protrusions and recesses are generated at the surface of the cloth as the rear surface of the cloth is brought into contact with the mesh by air suction by the air suction unit, the height from each of the recessed surface to each of the protruded surface is at most 0.5 mm.

The fluff suppressing unit includes an air emission unit for emitting air from the side of the head to the surface of the cloth facing the head. Accordingly, the fluff on the surface of the cloth facing the head is laid down to the surface of the cloth by the air emitted from the air emission unit. Therefore, the fluff neither hinder ink jet nor changes the direction of ink jet. Therefore, the ink is surely jet out and reach prescribed position on the surface of the cloth, whereby desired pattern is dyed without any distortion.

The air emission unit is formed integrally with the head, and includes a plurality of air emitting openings for emitting air around a plurality of orifices for jetting out the ink formed at the head. This assists suppression of fluff at that region of the cloth surface where the ink jet is directed.

The plurality of air emission openings are formed within 10 mm from respective ones of the plurality of orifices.

The direction of air emission from each of the plurality of air emission openings is near the direction of ink jet from each of the plurality of orifices.

The amount of air emitted from each of the plurality of air emission openings is uniform and constant. Accordingly, the fluff at the region of the cloth surface where ink jet is directed can surely be suppressed stably.

The pressure for emitting air at each of the plurality of air emission openings is 1.2 to 3 times the atmospheric pressure.

The air emitting unit includes an air supply inlet for supplying external air to be emitted from the plurality of air emission openings, and an air supply path provided common to the plurality of air emission openings for communicating the air supply inlet with each of the plurality of air emission openings. Difference between distance from the air supply inlet to one of the plurality of air emission openings and from the air supply inlet to another one of the air emission openings is at most 10 cm. Thus the amount of air supplied from the air supply inlet to the air emission openings and emitted therefrom can be made uniform.

The fluff suppressing unit includes an air suction unit for sucking air from the rear side of the cloth so as to attain negative pressure at the rear surface side of the cloth, which cloth is facing the head, and an air emission unit for emitting air to the surface of the cloth facing the head from the side of the head. Accordingly, the air is sucked from the rear surface of the cloth facing the head, while air is emitted from the head side to the surface of the cloth facing the head. Accordingly, fluff of the surface of the cloth facing the head can more effectively be suppressed. Accordingly, ink jet is not hindered by the fluff, and hence desired pattern can be dyed without any distortion by ink jet.

The fluff suppressing unit including the air suction unit and the air emission unit further has a hollow platen having an opening to be in contact with the rear surface of the cloth opposing to the head, and the platen is connected to the air suction unit by the path of air flow sucked by the air suction unit.

Therefore, the effect provided by air suction and air emission through the opening while the cloth is conveyed covering the opening of the platen is improved, so that influence of fluff on the dyeing of the cloth surface can more effectively be suppressed.

The fluff suppressing unit including the air suction unit and the air emission unit further includes a recess formation suppressing unit for suppressing formation of recesses at the surface of the cloth at the opening of the platen.

Consequently, the state in which the cloth enters the hollow platen through the opening and is curved considerably by suction and emission of air can be prevented. The distance between the head and the surface of the cloth is kept constant, and the jet ink surely reaches the prescribed position on the surface of the cloth, so that distortion of pattern can be avoided.

With the fluff suppressing unit provided with air suction unit and air emission unit, the recess formation suppressing unit allows conveying of cloth stretched tight by the supply roller and the take up roller for conveying the cloth, with the cloth facing the head having its rear surface being in contact with the opening of the platen. Accordingly, the recess formation suppressing unit can be provided utilizing the supply roller and the take up roller for conveying the cloth, and therefore the recess formation suppressing unit can be provided without increasing the number of parts or cost.

With the fluff suppressing unit provided with the air suction unit and the air emission unit, the recess formation suppressing unit includes a mesh allowing passage of air, covering the opening of the platen.

Therefore, a state in which the cloth enters the hollow platen through the opening by suction and emission of air and curves considerably can be prevented, and distance between the head and the surface of the cloth can be maintained constant. Accordingly, the jet ink can surely attain the prescribed position on the surface of the cloth, and patterns can be dyed without any distortion.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 8 shows, in a table, variation in offset of ink drop from the target position at the surface of the cloth with respect to variation in distance between the ink jet head and the surface of the cloth as well as variation in speed of ink emission, of the ink jet head shown in FIG. 1.

DESCRIPTION OF THE PREFERRED EMBODIMENTS

An ink jet dyeing apparatus for dyeing cloth having fluff on its surface in a desired pattern by ink jet method in accordance with the first to third embodiments of the present invention will be described in detail with reference to the drawings.

First Embodiment

Figure 1:
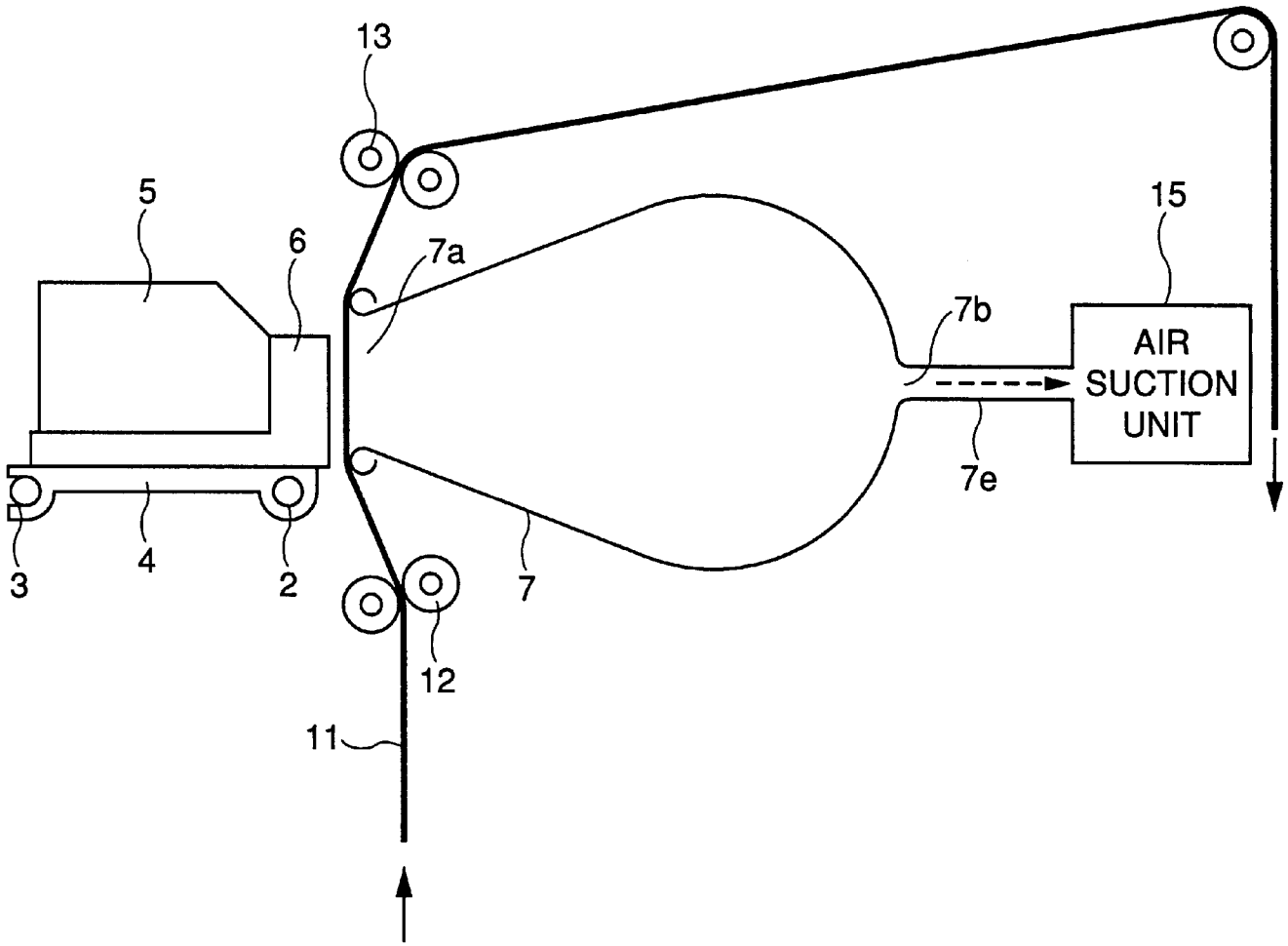
FIG. 1 is a schematic illustration showing the structure of an ink jet dyeing apparatus in accordance with a first embodiment of the present invention.
Figure 2A:
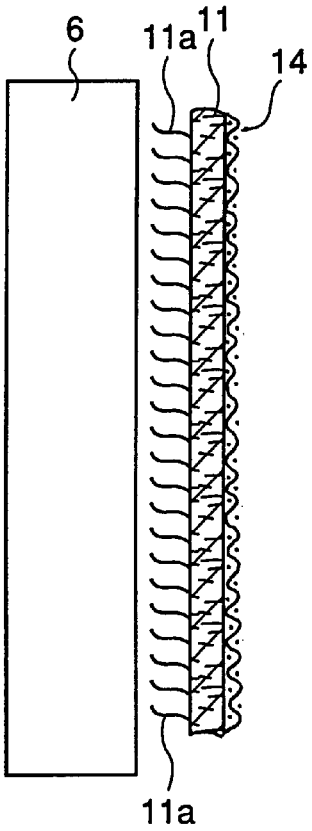
FIGS. 2A to 2C are illustrations showing the state of the surface of the cloth at the time of dyeing, in accordance with the first to third embodiments of the present invention.
Figure 2B:
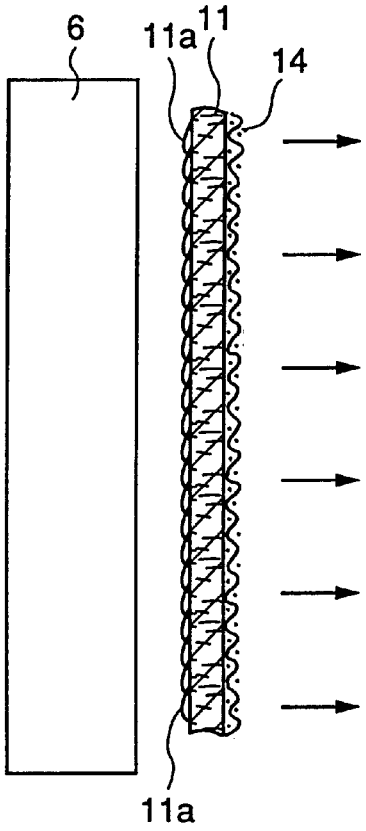
Figure 2C:
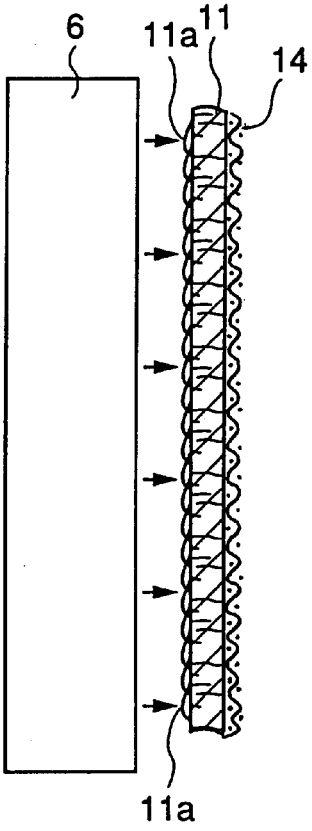
Figure 3:
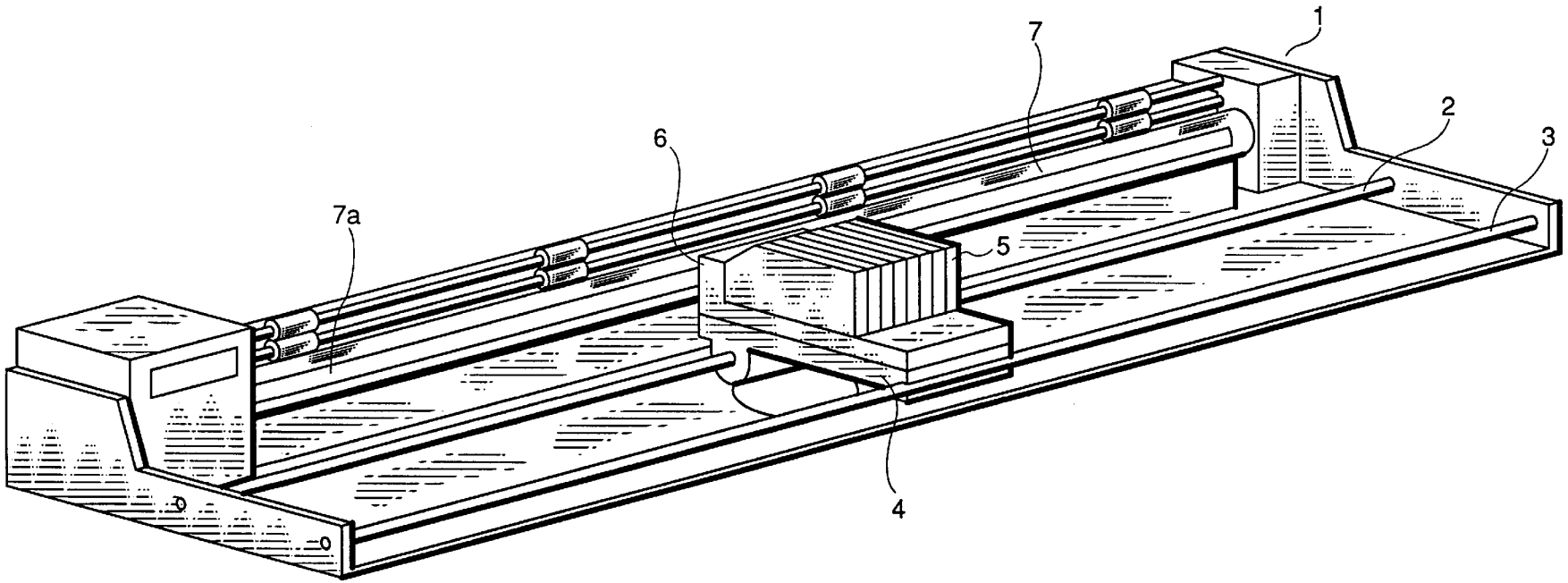
FIG. 3 is a perspective view showing appearance of the ink jet dyeing apparatus shown in FIG. 1.
Figure 4:
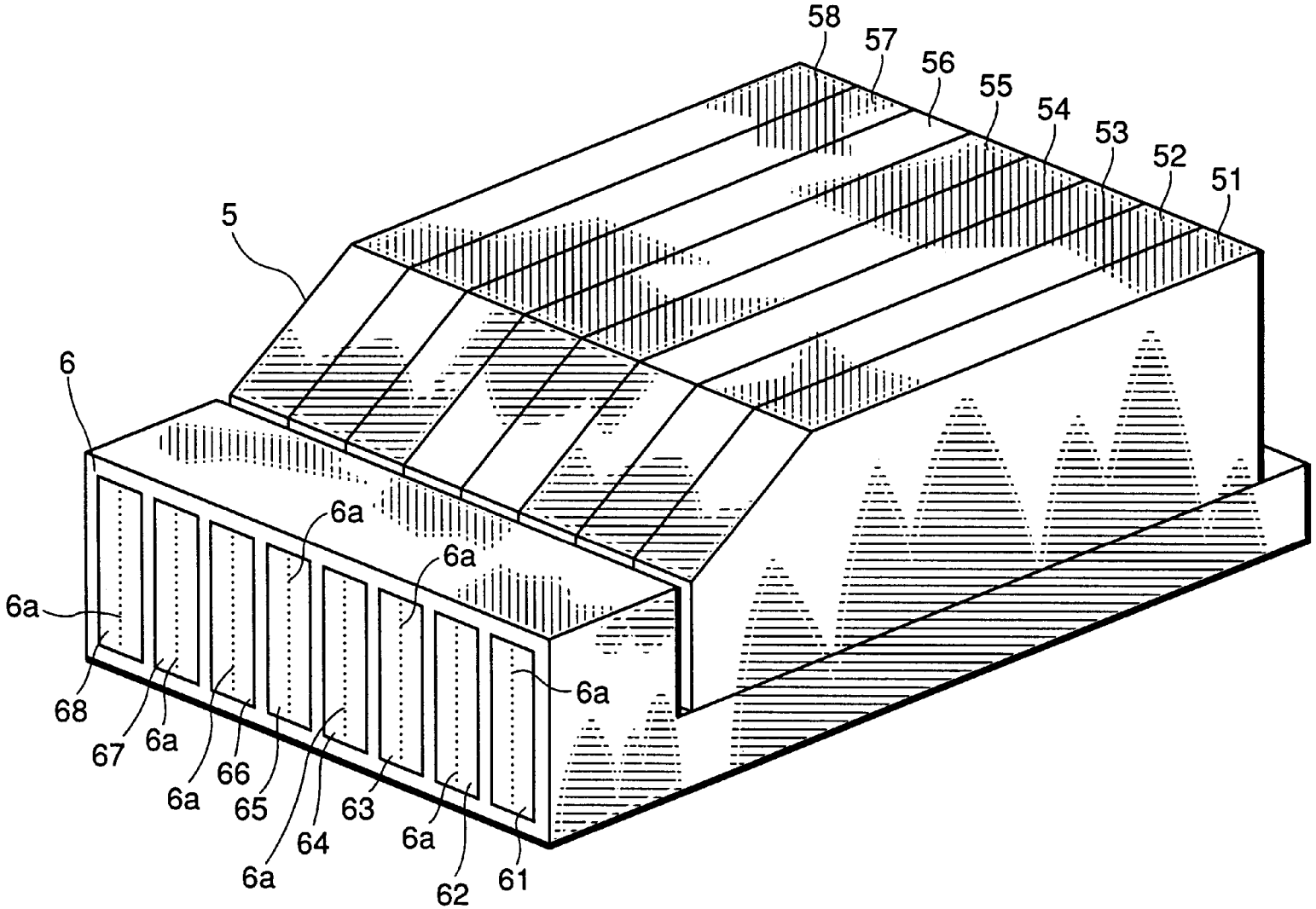
FIG. 4 is a perspective view taken from the side of ink jetting face of the ink jet head of the ink jet dyeing apparatus shown in FIG. 1.
Figure 5A:
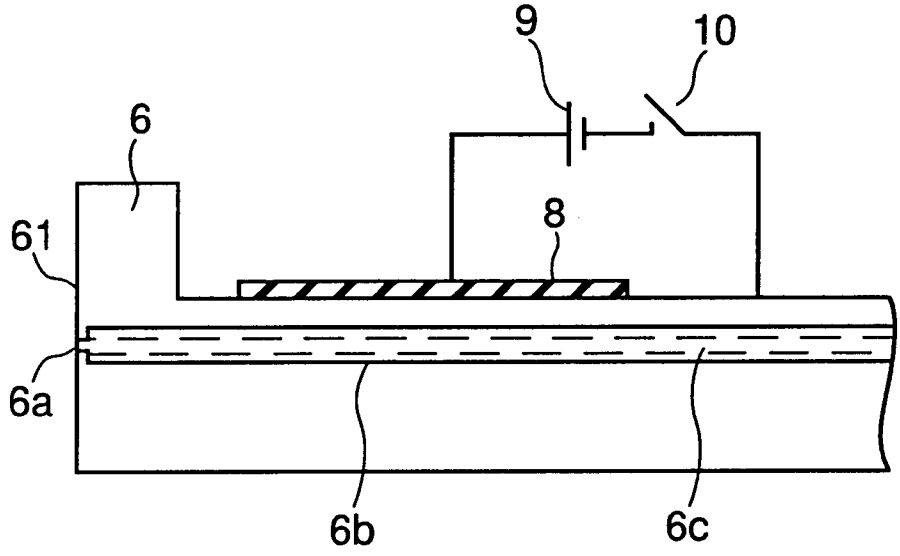
FIGS. 5A and 5B are cross sections showing basic structure for ink jetting, in the ink jet head applied to the first to third embodiments of the present invention.
Figure 5B:
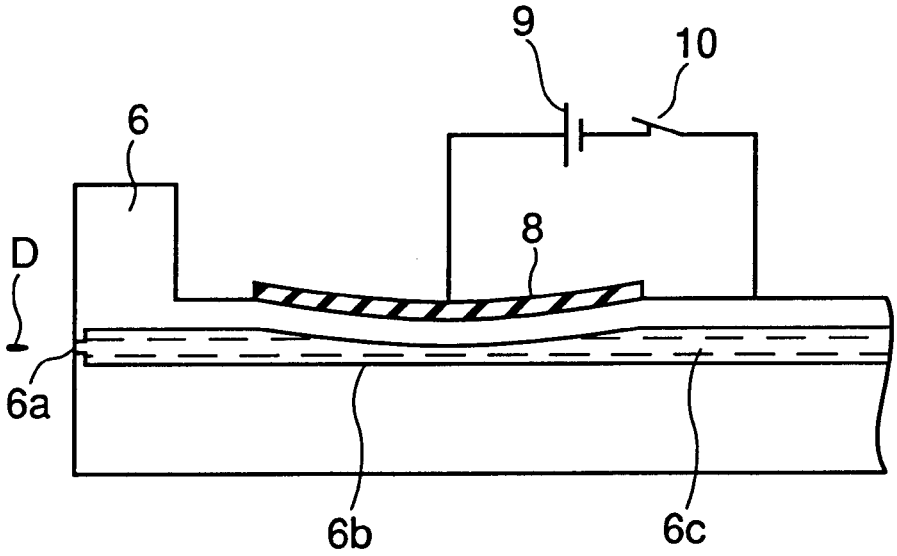

FIG. 1 is a schematic illustration showing the structure of the ink jet dyeing apparatus in accordance with a first embodiment of the present invention. FIGS. 2A to 2C are illustrations showing the state of the surface of the cloth when dyeing is performed in accordance with the first to third embodiments of the present invention. In FIGS. 2A to 2C, arrows represent direction of air flow for suppressing fluff on the surface of the cloth. FIG. 3 is a perspective view showing appearance of the ink jet dyeing apparatus shown in FIG. 1. FIG. 4 is a perspective view taken from the side of ink jetting face of the ink jet head jetting ink, of the ink jet dyeing apparatus. FIGS. 5A and 5B are cross section showing the basic structure for ink jet, in the ink jet head applied to the first to third embodiments of the present invention.

The structure of the ink jet dyeing apparatus in accordance with the first embodiment will be described with reference to FIGS. 3, 4, 5A and 5B. Referring to FIG. 3, an ink jet dyeing apparatus has two slide shafts 2 and 3 fixed on frames on opposing ends of a body 1, a carriage 4 slidably provided on slide shafts 2 and 3, and an ink cartridge unit 5 and an ink jet head 6 which are mounted on carriage 4.

Ink jet head 6 selectively jets ink while it moves sliding over slide shafts 2 and 3, whereby a desired pattern is formed (dye) on the surface of a recording medium, cloth in this embodiment, positioned in front of the ink jetting face. A platen 7 is arranged parallel to slide shafts 2 and 3 on the side where the cloth is positioned, to oppose to the ink jetting face of head 6, as will be described later.

Platen 7 is a hollow member as shown in FIG. 1. It is coupled to an air suction unit 15 for sucking air through air path 7*e* and suction opening 7*b* at its rear portion. At its front portion, that is, at a portion facing ink jet head 6, the platen 7 has an opening 7*a*.

Ink jet head 6 is provided with ink jet faces 61 to 68 each having a plurality of orifices 6*a* (represented by a dotted line in the figure) for jetting ink, for different colors of ink, respectively, as shown in FIG. 4. Ink cartridge unit 5 includes ink cartridges 51 to 58 reserving ink for respective ink jet faces 61 to 68.

Each of ink cartridges 51 to 58 is communicated with the corresponding plurality of orifices 6*a* through an ink supply path, not shown, and constantly supplies ink to an ink chamber, which will be described later placed midway of the ink supply path, or in front of the plurality of orifices 6*a*. In the example of FIG. 4, assuming that eight difference colors of ink are used for dyeing, ink cartridges 51 to 58 are provided for respective ones of eight different colors. The number of colors of the ink used is not limited. When it is possible to represent a new color by superposing various colors, at least four ink cartridges may be prepared corresponding to at least yellow, magenta, cyan and black ink. If it is not possible to represent a new color by superposing a plurality of different colors, ink cartridges may be provided respectively for the various colors used.

Each of the ink cartridges 51 to 58 is provided detachably from ink jet head 6, and when the reserved ink is used up, it is exchanged. In place of ink cartridge unit 5, a large ink tank provided separate from the ink jet head 6 may be used for supplying ink to each of the ink chambers of head 6. In that case, the ink tank may be connected through a flexible pipe or the like providing an ink supply path to head 6, and the flexible pipe or the like is communicated with ink supply path described above of the ink jet head 6.

The structure and principle for jetting ink from ink jet head 6 will be described with reference to FIGS. 5A and 5B. Though description is only on the ink jet face 61, the same applies to other ink jet faces 62 to 68. Referring to 5A, in ink jet head 6, there is an ink chamber 6*b* midway of ink supply path communicated with the plurality of orifices 6*a* provided at the ink jet face 61, and corresponding to ink chamber 6*b* for pressurizing ink in ink chamber 6*b*, a piezo oscillator 8, a voltage source 9 and a switch 10 are provided. Ink from a corresponding ink cartridge 51 is supplied by capillary action to ink chamber 6*b* through a filter 6*c* placed between ink chamber 6*b* and cartridge 51, so that ink chamber 6*b* is always filled with ink. By turning ON/OFF switch 10 for selectively supplying voltage from voltage source 9 to piezo oscillator 8 in this state, ink in ink chamber 6*b* is jetted out from the plurality of orifices 6*a*. More specifically, when switch 10 is turned ON, voltage from voltage source 9 is supplied to piezo oscillator 8, whereby piezo oscillator 8 deflects to the inside of ink chamber 6*b* by unimorph operation by piezo oscillator 8 and a plate of inner wall of ink chamber 6 (see FIG. 5B), whereby ink chamber 6*b* is pressurized, so that the volume of ink chamber 6*b* is reduced. By the pressure wave generated at this time, the ink of ink chamber 6*b* is jetted out as ink drops D from the plurality of orifices 6*a* as shown in FIG. 5B. The jetted ink drops D reach the surface of cloth placed in front of the ink jet face 61, so that the surface of the cloth is dyed in the colors of ink drops D. By selectively controlling ON/OFF of switch 10 while ink jet head 6 moves sliding over slide shafts 2 and 3, the cloth is dyed in a desired pattern.

Referring to FIG. 5A, when voltage supply to piezo oscillator 8 is stopped, piezo oscillator 8 resumes the original shape. As the pressure in ink chamber 6*b* is reduced and the volume of the ink chamber changes at this time, ink is supplied to ink chamber 6*b*. Therefore, ink chamber 6*b* is always kept full with ink.

Referring to FIG. 1, at that portion of platen 7 which is facing ink jet faces 61 to 68 of ink jet head 6, an opening 7*a* is formed as shown in the figure. At the rear portion, a suction opening 7*b* is provided, which is communicated through air path 7*e* to air suction unit 15 for sucking air in the direction of the dotted arrow. Opening 7 is provided in the air flow path generated by air suction. Cloth 11 is conveyed in the direction of the solid arrow in the figure, such that its surface is positioned facing the ink jet face of head 6. At this time, supply roller 12 supplies cloth 11 to the direction of opening 7*a* of platen 7, and after the cloth 11 is passed through the opening 7*a* of platen 7, the cloth 11 is taken up from opening 7*a* by take up roller 13.

In this manner, cloth 11 is conveyed suspended by supply roller 12 and take up roller 13 preceding and succeeding platen 7, which platen is facing ink jet faces 61 to 68 of ink jet head 6. Therefore, opening 7*a* of platen 7 is positioned between supply roller 12 and take up roller 13, and ink jet faces 61 to 68 of ink jet head 6 are positioned opposing to opening 7*a*.

By platen 7 having opening 7*a* at a front portion and suction opening 7*b* at a rear portion, air is sucked in the direction of the dotted arrow of FIG. 1 behind cloth 11 conveyed by supply roller 12 and take up roller 13. The change in state of fluff of the surface (surface to be dyed) of cloth 11 caused by air suction will be described. Referring to FIG. 2A, fluff 11*a* is raised at the surface of cloth 11. When air suction is performed from behind (rear surface of) cloth 11, fluff 11*a* on that surface of cloth 11 which is facing ink jet head 6 (front surface of cloth 11) are sucked to be laid down on the surface of cloth 11 as shown in FIG. 2*b* by the air being sucked. In this state, ink is selectively jetted out by ink jet head 6 to the surface of cloth 11. Therefore, ink jet is not hindered by fluff 11*a*, ink drops reach at desired positions on the surface of cloth 11, and dyeing operation successively takes place, in accordance with the intended pattern.

When air suction is not performed in the state of FIG. 2A, fluff 11*a* on the surface of cloth 11 would touch ink jet faces 61 to 68 of ink jet head 6, and the plurality of orifices 6*a* provided at the ink jet face will be closed by fluff 11*a*. However, as air suction is performed as described above, fluff 11*a* is sucked and laid down on the surface of cloth 11, that is, the state of fluff changes from that shown in FIG. 2A to that shown in FIG. 2B. Therefore, direction of the jetted ink would not be varied by fluff 11*a*, and ink drops D can reach desired position on the surface of cloth 11, accomplishing dyeing.

Opening 7*a* provided in the lengthwise direction of platen 7 is formed over a length which corresponds to the range of movement of ink jet head 6 sliding along slide shafts 2 and 3. Accordingly, when the air is sucked, cloth 11 is curved in the direction of air suction (the direction of the dotted arrow in FIG. 1). More specifically, cloth 11 is pulled by air suction into the hollow portion of platen 7, and the cloth partially enters inside the platen 7 and curves. When there is a curved portion (recessed portion) formed on platen 7, the position on the surface of cloth to be reached by ink drops D jetted from ink jet head 6 would be offset from the desired position. Therefore, it is important that the surface of cloth 11 facing ink jet head 6 always has a constant, invariable state.

In order to relieve the curve of cloth 11 and to suppress offset in position reached by ink drops D, cloth 11 is conveyed by supply roller 12 and take up roller 13 provided upstream and downstream of opening 7*a* in the path of conveying cloth 11 shown in FIG. 1 such that cloth 11 is in tight contact with upper and low edges of opening 7*a* of platen 7 and, at the same time, that uniform force is applied by rollers 12 and 13 to cloth 11. For example, when opening 7*a* of platen 7 is positioned in the middle of supply roller 12 and take up roller 13 in the conveying path of cloth 11 shown in FIG. 1 and uniform force is applied for conveying cloth 11 by rollers 12 and 13, then cloth 11 is suspended on both sides of upper and lower edge of opening 7*a* of platen 7, and therefore cloth 11 is prevented from entering the hollow platen 7 when the air is sucked in. At this time, cloth 11 is pulled upward and downward in FIG. 1, and the cloth is in tight contact with the upper and lower edges of opening 7*a*, and therefore air suction can effectively be utilized. As a result, the effect of laying down the fluff 11*a* on that surface of cloth 11 which is facing ink jet 6 on the surface of cloth 11 is improved.

Supply roller 12 and take up roller 13 are arranged such that cloth 11 enters a little in the platen 7. Accordingly, cloth 11 is conveyed while it is being in contact with upper and lower edges of opening 7*a* of platen 7 with an appropriate pressure. In this manner, cloth 11 can be conveyed stretched tight by rollers 12 and 13, whereby cloth 11 is not much curved at opening 7*a* by air suction, and that surface of cloth 11 facing ink jet head 6 is kept flat. Further, cloth 11 is in tight contact with opening 7*a*, and therefore opening 7*a* is surely covered with cloth 11, so that efficiency of air suction is improved. As a result, the effect of suction of fluff 11*a* to be surely laid down on the surface of cloth 11 as shown in FIG. 2B is promoted.

In order to convey cloth 11 efficiently while the cloth is pulled by supply roller 12 and take up roller 13, the speed of feeding of cloth 11 by take up roller 13 is set a little faster than the speed of feeding of cloth 11 by supply roller 12. Consequently, cloth 11 is conveyed with an appropriate tension, whereby curving of cloth 11 at opening 7*a* by air suction can be prevented.

Figure 6:
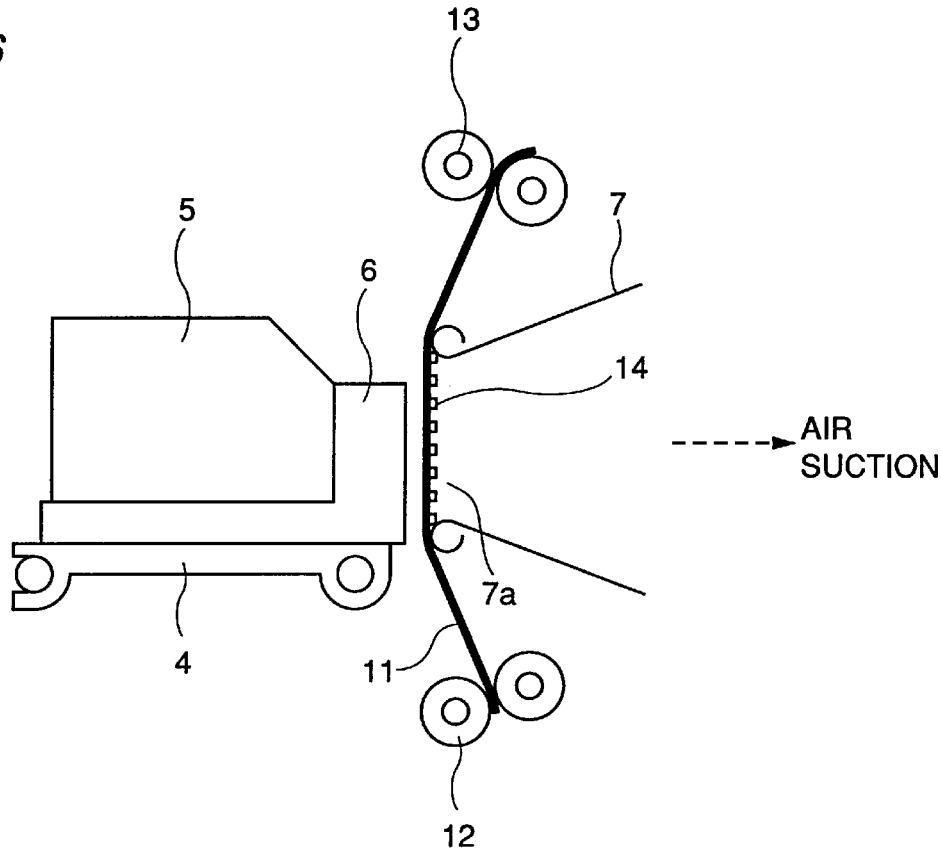
FIG. 6 is a schematic diagram showing another structure of the ink jet dyeing apparatus in accordance with the first embodiment of the present invention.

FIG. 6 is a schematic diagram showing another structure of the ink jet dyeing apparatus in accordance with the first embodiment of the present invention. The structure of FIG. 6 includes, in addition to the structure of FIG. 1, a mesh 14. The structure is the same as that of FIG. 1 except this point. In order to prevent curving of cloth 11 at opening 7*a* of platen 7 by air suction, opening 7*a* of platen 7 may be covered by a metal mesh 14 allowing passage of air, as shown in FIG. 6. Air is sucked through cloth 11 and mesh 14, and therefore entrance and curving of cloth 11 towards the hollow platen 7 can be prevented by mesh 14.

Mesh 14 allows passage of air and prevents curving of cloth 11. Each opening of mesh 14 must have an area large enough to allow passage of an amount of air sufficient to attract fluff 11*a* of cloth 11 to be laid down on the surface of cloth 11. In other words, mesh 14 should preferably have large openings in order to improve effect of attracting fluff 11*a* to be laid down on the surface of cloth 11 by air suction. However, if each opening is too large, provision of mesh 14 itself would be meaningless. More specifically, when each opening is large, soft cloth 11 enters hollow platen 7 considerably through each opening of mesh 14, by air suction. Therefore, when each opening of mesh 14 is large, cloth 11 would be recessed at each opening of mesh 14, with the size of the recess made larger as the opening is made larger. In order to prevent this problem, the area of each opening of mesh 14 should be at most 25 $cm^2$, as will be described later.

Figure 7A:
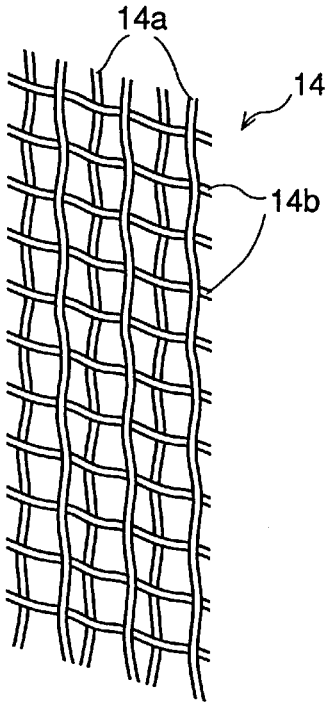
FIGS. 7A and 7B are illustrations showing the structure of the mesh shown in FIG. 6.
Figure 7B:
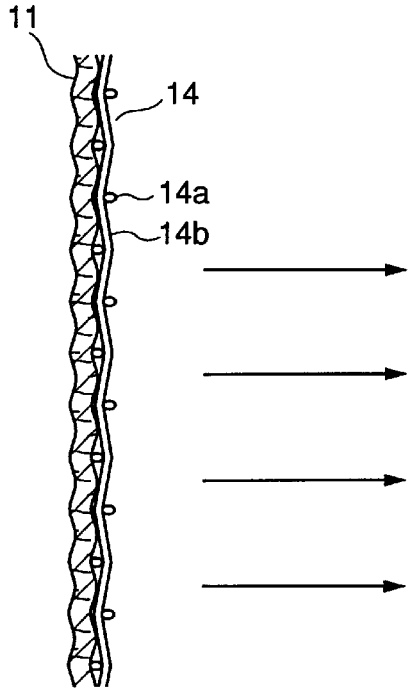

FIGS. 7A and 7B are illustrations of the mesh structure shown in FIG. 6. Mesh 14 is formed by weaving warp and weft 14*a* and 14*b* both of metal, as shown in FIG. 7A. Cloth 11 is in tight contact with the recessed and protruded surfaces formed by weaving of warp and weft 14*a* and 14*b* of mesh 14. At this time, sizes of recess and protrusion are determined by the diameters of warp and weft 14*a* and 14*b*, as shown in FIG. 7B. Therefore, if the recesses and protrusions on the surface of cloth 11 are considerably large, the position on the surface of cloth 11 reached by jetted ink drops D would be offset from the positions reached when there is not any recess or protrusion, whereby satisfactory dyeing would be impossible. In order to prevent this problem, the height from each protruded surface to each recessed surface formed at the surface of cloth 11 should necessary be at most 0.5 mm, as will be described later. The height from each recessed surface to each protruded surface of cloth 11 would be referred to as level difference. The position reached by ink drops D on the surface of cloth 11 when there is not any recess or protrusion at the surface of cloth 11 would be referred to as desired target position. Further, offset of the actual position reached from the desired target position would be referred to as offset from target position in the following.

The reason why the level difference should be at most 0.5 mm will be described. When printing is done by an ink jet printer at the density of 180 dpi and ink jet period of 5 kHz, the speed of movement of ink jet head 6 is 70.5 cm/sec. The speed of jetting ink from ink jet head 6 is set to 6 m/sec. At this time, the direction of emission of ink drop D matches the direction of a vector of 6 m/sec. and 0.705 mm/sec. Accordingly, when the distance between ink jet head 6 and cloth 11 is enlarged when there is formed a recess at the surface of cloth 11, ink drop D would be offset from the target position at the surface of cloth 11. Offset from target position will be eliminated when the distance between ink jet head 6 and the surface of cloth 11 is kept constant, that is, when the cloth 11 does not have any recess or protrusion on its surface. However, the larger the level difference, the longer the period of travel of ink drop D, resulting in larger offset from target position. Accordingly, the pattern to be formed on the surface of cloth 11 by ink drops D would be distorted to a larger extent. When offset from target position is not larger than ½ dot (0.075 mm), the distortion of pattern formed on the surface of cloth 11 is not at all a problem. FIG. 8 shows, in a table, variation in offset from target position, on the surface of cloth 11 of ink drops D with respect to the variation in distance DT between ink jet head 6 and the surface of cloth 11 and variation of the speed of ink emission, of the ink jet head of FIG. 1.

Referring to FIG. 8, the speed of ink emission from ink jet head 6 is varied from 8 m/s, to 6 m/s and 4 m/s. In Case 1, offset from target position of ink drop D at the surface of cloth 11 for respective ink emission speed when the distance DT between ink jet head 6 and the surface of cloth 11 is 4 mm are shown. Similarly, Case 2 shows offset from target position for respective ink emission speed when the distance DT is 3.5 mm. Case 3 shows offset from target position for respective ink emission speed when distance DT is 3 mm.

Cases 4 and 5 show variation in offset from target position for respective ink emission speed, respectively, when variation ΔDT in distance DT is 1 mm and 0.5 mm, respectively. The variation in offset from target positions of Case 4 is obtained from values of Cases 1 an 3, and variation in offset from target position of Case 5 is obtained from values of Cases 1 and 2.

As can be understood from FIG. 8, when the speed of emission of ink is increased, the offset from target position is made smaller. When the speed of emission of ink is constant, the offset from target position is always constant. Therefore, provided that the surface of cloth 11 is flat without any recess or protrusion, there will never be an offset from target position. When there is recesses and protrusions on the surface of cloth 11 with the level difference exceeding 1 mm, then offset from target position would never be smaller than 0.075 mm even when the speed of ink emission is increased. When the level difference is set to be 0.5 mm at most, the offset from target position can be suppressed to at most 0.0588 mm with the ink emission speed of 6 m/sec.

Therefore, when mesh 14 is provided at opening 7*a* of platen 7 as shown in FIG. 6, mesh 14 having warp and weft 14*a* and 14*b* having diameters and spaces selected appropriately to ensure level difference of at most 0.5 mm at the surface of the cloth 11 should preferably be used. Here, the area of each opening of mesh 14 is determined dependent on the thickness of cloth 11 and magnitude of air suction pressure. An experiment with conducted using a thin and soft cloth 11 for a T shirts with inner pressure of platen 7 set to 0.7 Pa and 0.5 Pa, respectively. The preferable area of each opening of mesh 14 was at most 25 $cm^2$.

In order to ensure level difference of 0.5 mm with the inner pressure of platen 7 being 0.7 Pa, the area of each opening of mesh 14 may be enlarged to 30 $cm^2$. Further, it is important that cloth 11 over platen 7 is pulled and suspended (or stretched) by supply roller 12 and take up roller 13.

Second Embodiment

In the first embodiment, fluff 11*a* of the surface of cloth 11, that is, the surface facing ink jet head 6 is sucked to be laid down on the surface 11*a* of cloth, by air suction from behind the cloth 11.

However, when air suction is performed from the side of platen (from behind cloth 11) as in the first embodiment, highly dense cloth does not allow passage of much air, though cloth 11 can be brought into tight contact with platen 7. At this time, the speed of movement of the air remarkably decreases away from cloth 11, and therefore it becomes difficult to have tip portions of long fluff 11*a* laid down on the surface of cloth 11. Accordingly, in the second embodiment, an ink jet drying apparatus is disclosed in which air is jet out to the surface of cloth 11 from the side of the head, so as to lay down fluff 11*a* as shown in FIG. 2C. In this case, air emission openings provided on the head are placed near orifices 6*a* for jetting ink, so that ink travels along with the emitted air flow. The air jet out from the plurality of air emission openings actually hit the surface of cloth 11 on platen 7, and flows to the direction of lower air pressure, that is, direction toward the air emission openings, realizing near ideal air flow.

Figure 9A:
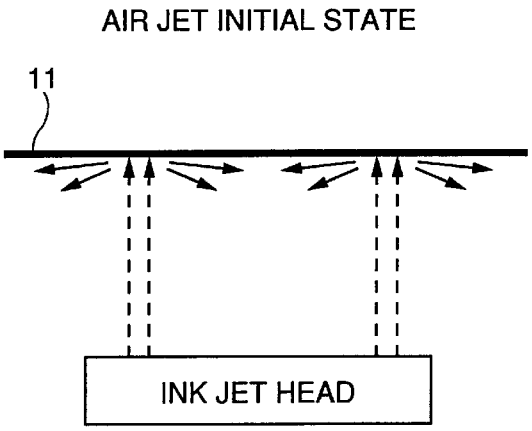
FIGS. 9A and 9B are illustrations related to air flow at the surface of the cloth when air is emitted from the side of the ink jet head to the cloth, in accordance with the second embodiment of the present invention.
Figure 9B:
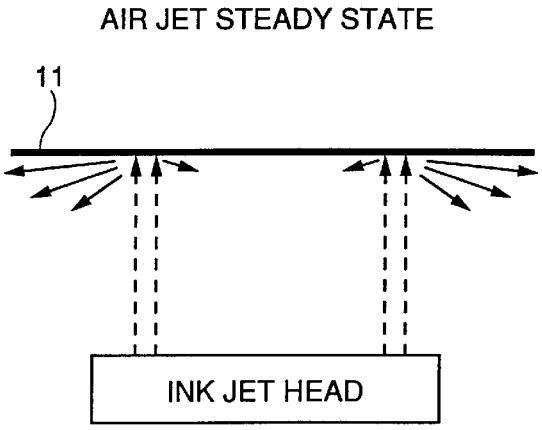

FIGS. 9A and 9B show air flow at the surface of the cloth when air is jetted from the ink jet head to the cloth in accordance with the second embodiment of the present invention. Utilizing the nature that gas and liquid flow from where pressure is high to where pressure is low, air is emitted (flows) from a high pressure portion of air emission opening to a low pressure portion at the surface of cloth 11 which is at the normal pressure. The air jetted from the plurality of air emission openings of the head initially hits the surface of cloth 11 and diffuse in all directions as shown in FIG. 9A. Thereafter, the portion surrounded by air emission openings tends to have higher pressure as the air flowing thereto cannot find any escape, and therefore air flow to this portion is hindered. Accordingly, the air flows to peripheral direction of air emission openings where air pressure is low, as shown in FIG. 9B.

Figure 10:
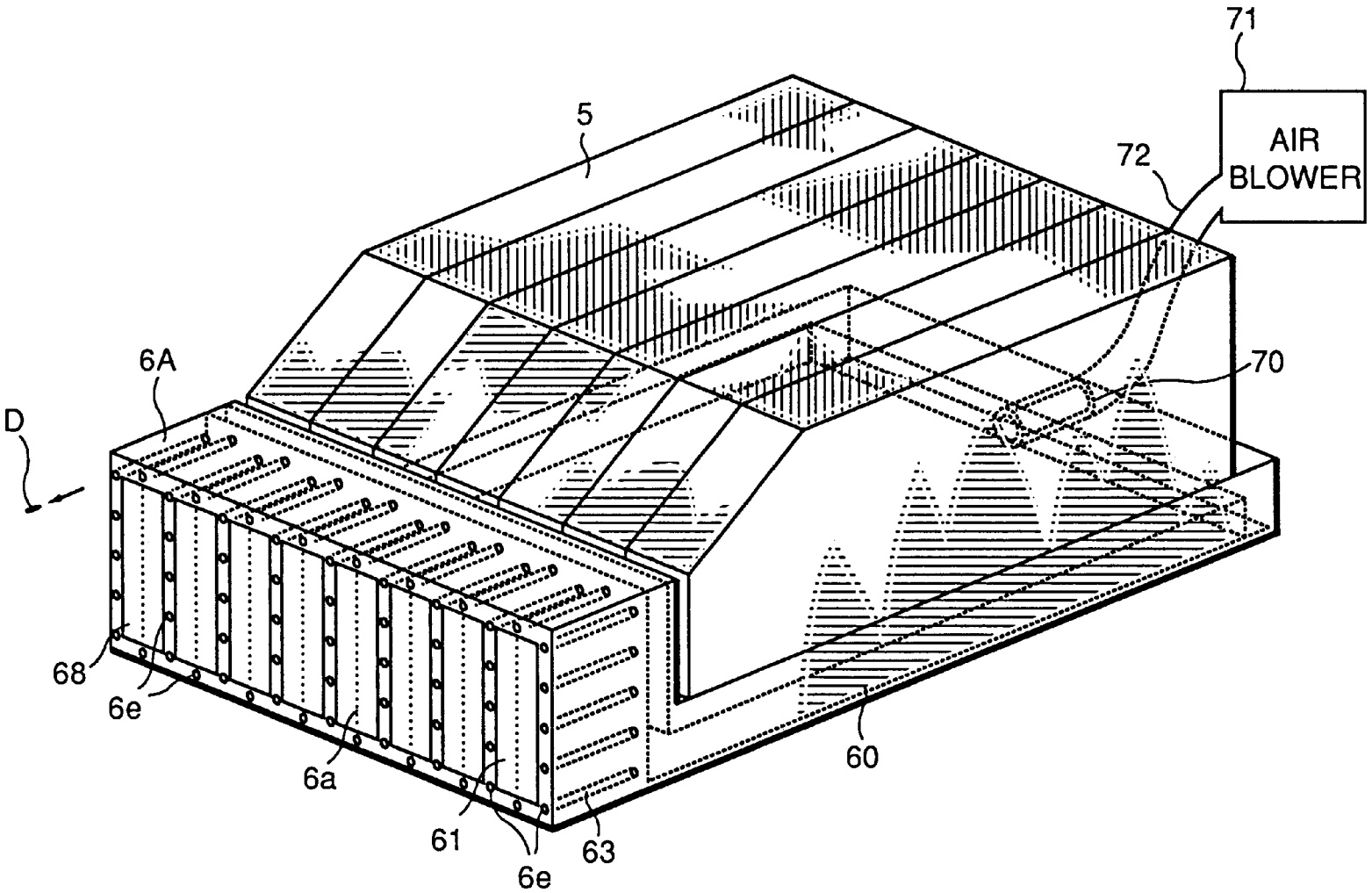
FIG. 10 shows an example of the ink jet head together with an ink cartridge portion, in accordance with the second embodiment of the present invention.

FIG. 10 is a perspective view showing together with ink cartridge unit 5, and example of ink jet head 6A in accordance with the second embodiment of the present invention. In addition to the structure of head 6 described above, ink jet head 6A includes: an air supply path 60 for emitting air from the same face as ink jet faces 61 to 68; an air supply inlet 70; an air blower 71; an air duct 72; and a plurality of air emission openings 6*e*. In ink jet head 6A, separate from ink supply path for supplying ink, there is formed an air supply path 60 for emitting air from the same face as ink jet faces 61 to 68. Air supply path 60 is provided with an air supply inlet 70 on the rear side of ink jet head 6A, which air supply inlet 70 is communicated with air blower 71 by air duct 72. On the side of ink jet faces 61 to 68 of ink jet head 6A, a plurality of air emission openings 6*e* are formed. Each opening 6*e* is communicated with air supply path 60 through communication hole 63. The plurality of emission openings 6*e* are arranged at equal distance to surround each ink jet faces 61 to 68.

Figure 11A:
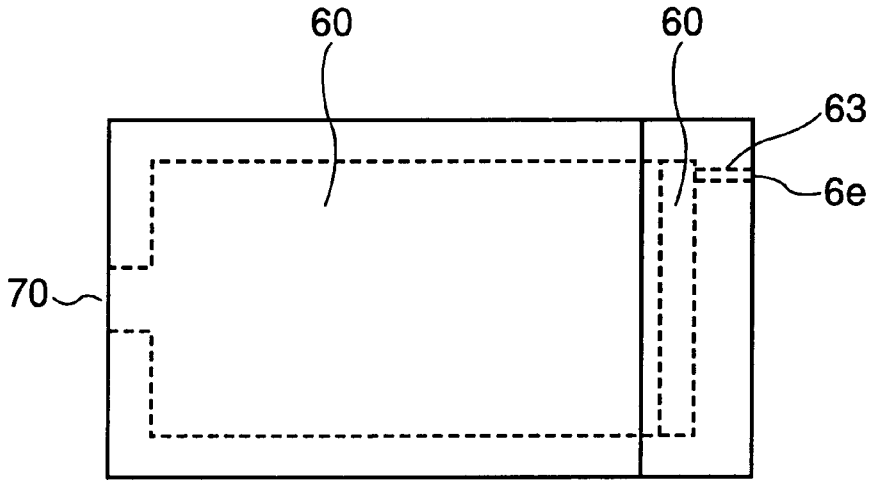
FIGS. 11A and 11B are top view and side view of the head of FIG. 10, respectively, showing the air supply path from the supply inlet to each emission hole of FIG. 10.
Figure 11B:
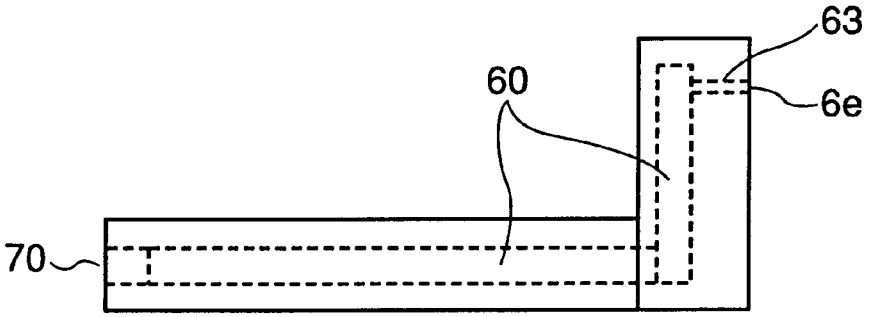

FIGS. 11A and 11B are top view and side view, respectively, showing air supply path 60 provided between air supply inlet 70 and each emission opening 6*e* of FIG. 10.

Figure 12:
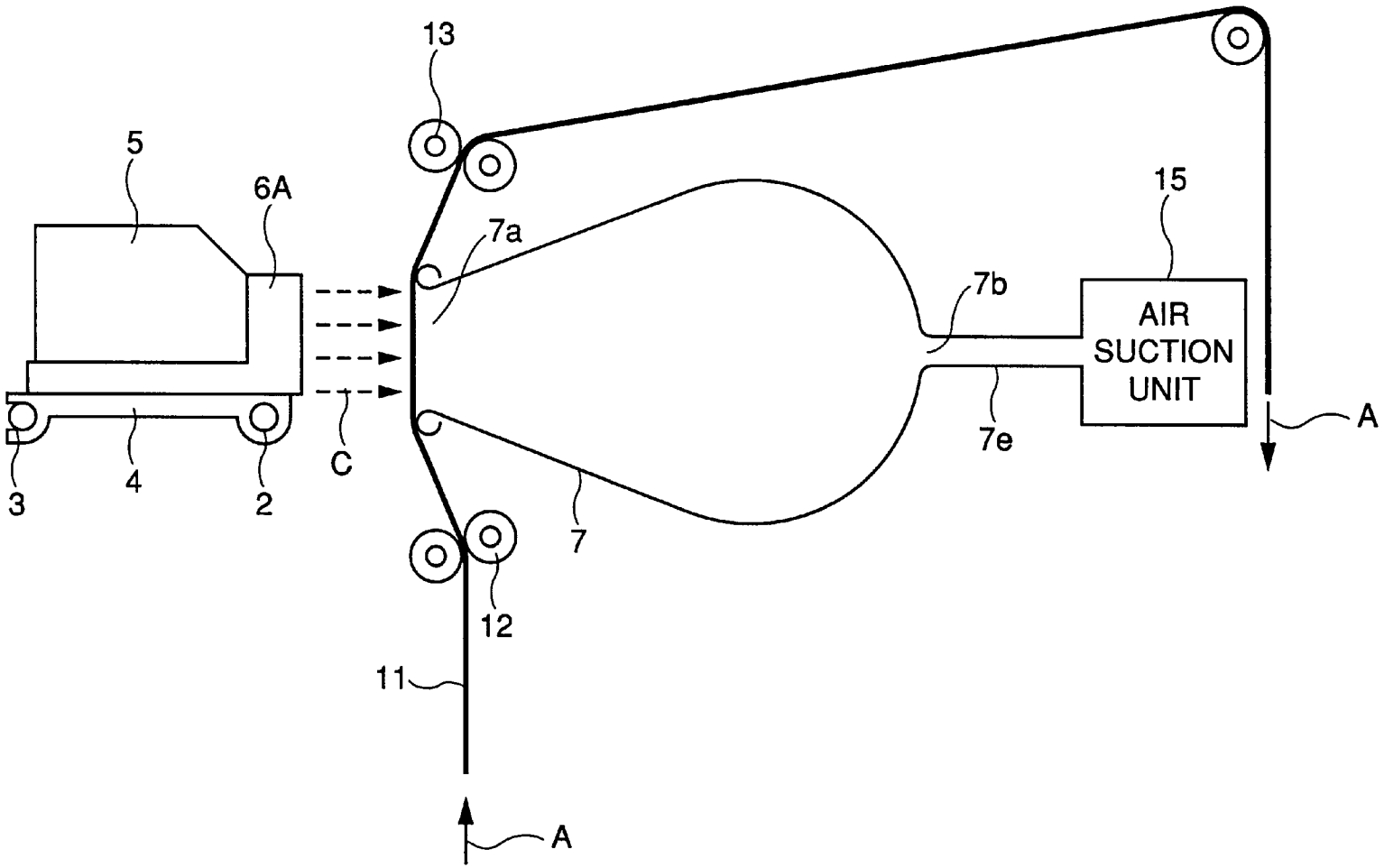
FIG. 12 is a schematic illustration showing an example of an ink jet dyeing apparatus mounting the ink jet head of FIG. 10.
Figure 13:
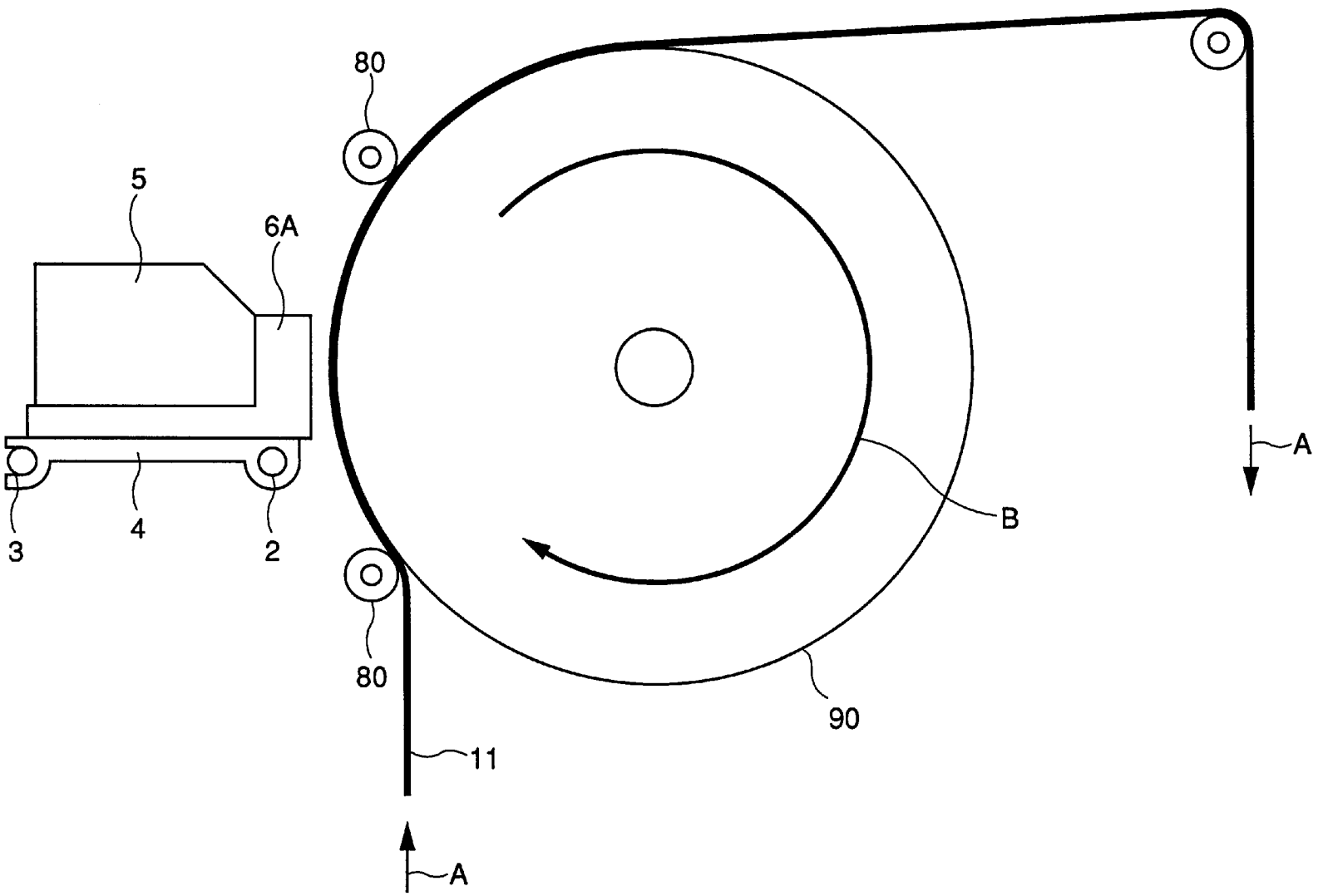
FIG. 13 is a schematic illustration of another example of the ink dyeing apparatus mounting the ink jet head of FIG. 10.
Figure 14:
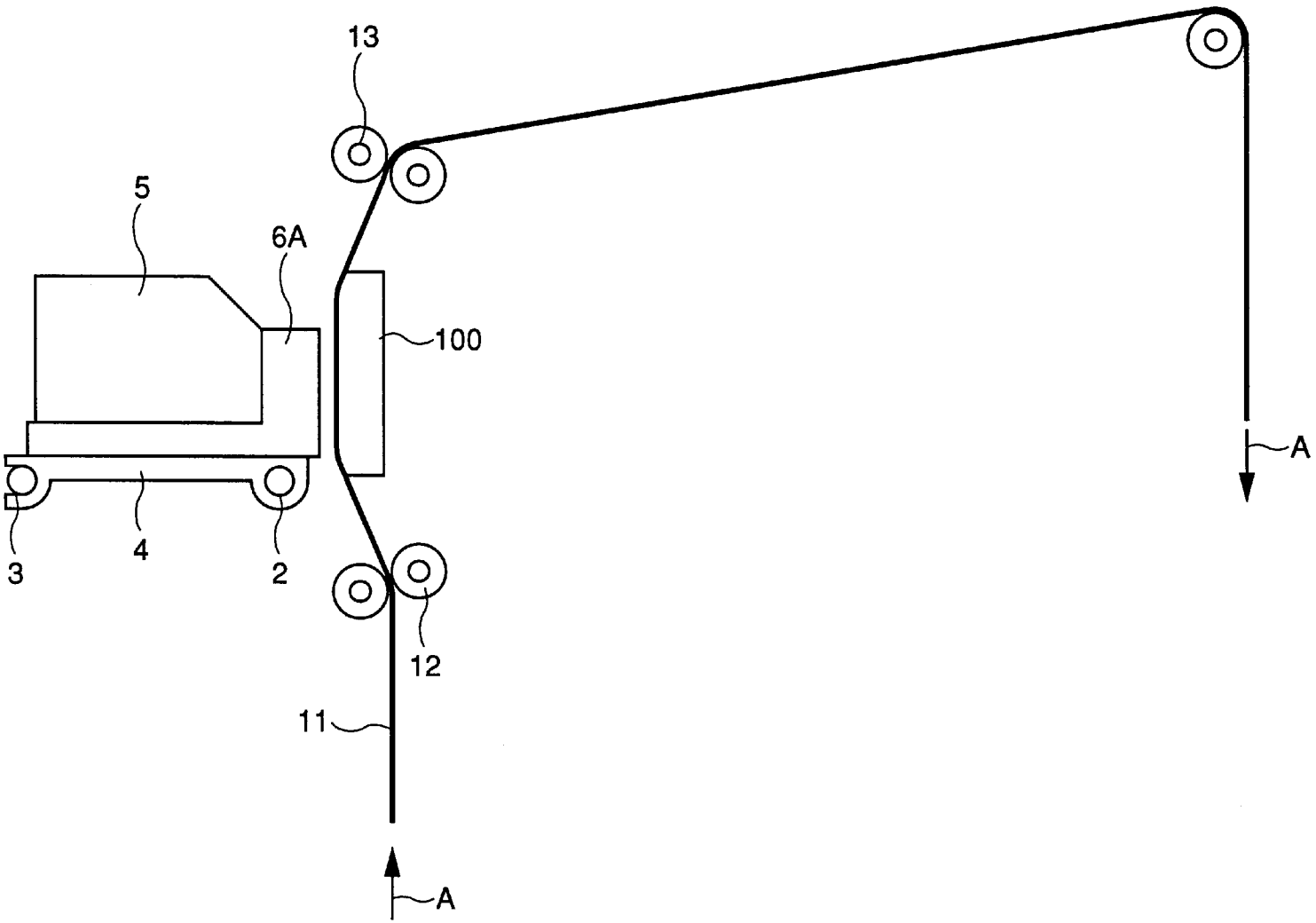
FIG. 14 is a schematic illustration showing a still further example of the ink jet dyeing apparatus mounting the ink jet head of FIG. 10.

FIGS. 12 to 14 are schematic illustrations showing one, another and further examples of ink jet dyeing apparatus mounting ink jet head 6A shown in FIG. 10 in accordance with the second embodiment of the present invention. The ink jet dyeing apparatus of the second embodiment may employ ink jet head 6A in place of ink jet head 6 of the dyeing apparatus of FIG. 1 so that there is not air suction from behind cloth 11, as shown in FIG. 12. Alternatively, the dyeing apparatus may have the structure shown in FIG. 13 or 14. The dyeing apparatus of FIG. 13 differs from that of FIG. 1 in that in place of platen 7, a conventional roll-shaped platen 90 not having any opening 7*a* is used for conveying cloth 11. Referring to FIG. 13, cloth 11 is wound around platen 90 rotating in the direction of the arrow B while the cloth is pulled by two cloth pressing rollers 80, and the cloth is conveyed in the direction of the arrow A as the platen 90 rotates.

The dyeing apparatus of FIG. 14 differs from that of FIG. 1 in that in place of platen 7, a flat shaped platen 100 not having any opening 7*a* is used for conveying cloth 11. In FIG. 14, cloth 11 is conveyed in the direction of the arrow A while the surface facing head 6A (the surface to which ink is jetted) is kept flat.

While the cloth is conveyed in the apparatuses shown in FIGS. 12 to 14, air is emitted to the surface of cloth 11 facing ink jet head 6A, so that fluff is suppressed and dyeing operation is performed by ink jet method. In the example of FIG. 12, cloth 11 is conveyed while suspended by rollers 12 and 13 as described in the first embodiment. Therefore, even when air is jetted thereto, cloth 11 is kept flat and not curved inward at opening 7*a*.

Referring to FIGS. 10 to 14, at the time of dyeing, ink jet head 6A is moved sliding along slide shafts 2 and 3, and ink is jetted selectively. Together with this ink jetting operation, air is fed by air blower 71 to air supply path 60, and air is directed to the surface of cloth 11 from each emission opening 6*e* as shown by the arrow C in FIG. 12, for example. At this time, referring to FIG. 2C, the fluff 11*a* on the surface of cloth 11 is blown to be laid down on the surface of cloth 11 by the air from each emission opening 6*e*. Consequently, the state and direction of jetting of ink drops D are not hindered by fluff 11*a*, and ink drops D reach desired position on the surface of cloth 11, enabling satisfactory dyeing of cloth 11.

Referring to FIG. 10, in order to ensure ink drops D jetted from each orifice 6*a* to reach correctly on the surface of cloth 11 free from the influence of fluff 11*a* on the surface of cloth 11, it is important to emit air uniformly from respective emission openings 6*e*. Therefore, air emission is preferably performed by providing emission openings 6*e* at equal distance and surrounding the plurality of orifices 6*a* at each of the jet faces 61 to 68. When each emission opening 6*e* is spaced by a large distance from each orifice 6*a*, the effect of laying down the fluff 11*a* on the surface of cloth 11 at the time of ink jet dyeing is lost. Therefore, each opening 6*e* should be provided within 10 mm from each orifice 6*a*. At this time, the direction of emission of the air from each emission opening 6*e* should be close to the direction of ink drop D reaching the surface of cloth 11, so as to ensure more accurate dyeing.

As to the amount of air emission from each emission opening 6*e*, the amount should necessarily be constant. Further, it is important that the plurality of emission openings 6*e* emit the same amount of air. Taking into consideration that air fed from air blower 71 is supplied to each emission opening 6*e* through one supply inlet 70 and one common supply path 60, the amount of air emitted from emission openings 6*e* would be uneven if the supply path 60 is too short, and the amount of air to be emitted would be small if the path 60 is too long. Assuming that ink jet head 6A is not shorter than 20 cm as in the case of a line head 7, when one air supply inlet 70 is provided and communicated to all the emission openings 6*e*, air is emitted strongly from that one of the emission openings 6*a* which is near the supply inlet 70, while air is emitted weakly from that one of emission openings 6*e* which is far from the supply inlet 70. In order to avoid such uneven air emission, difference in distance between each emission opening 6*e* to the supply inlet 70 should desirably be 10 cm at most.

The pressure for emitting air from each emission opening 6*e* is preferably 1.2 to 3 times the atmospheric pressure and more preferably, 1.5 to 2 times the atmospheric pressure.

In the structure shown in FIG. 12, mesh 14 may be provided behind cloth 11 as shown in FIG. 6 and air may be directed to the surface of cloth 11.

Third Embodiment

Figure 15:
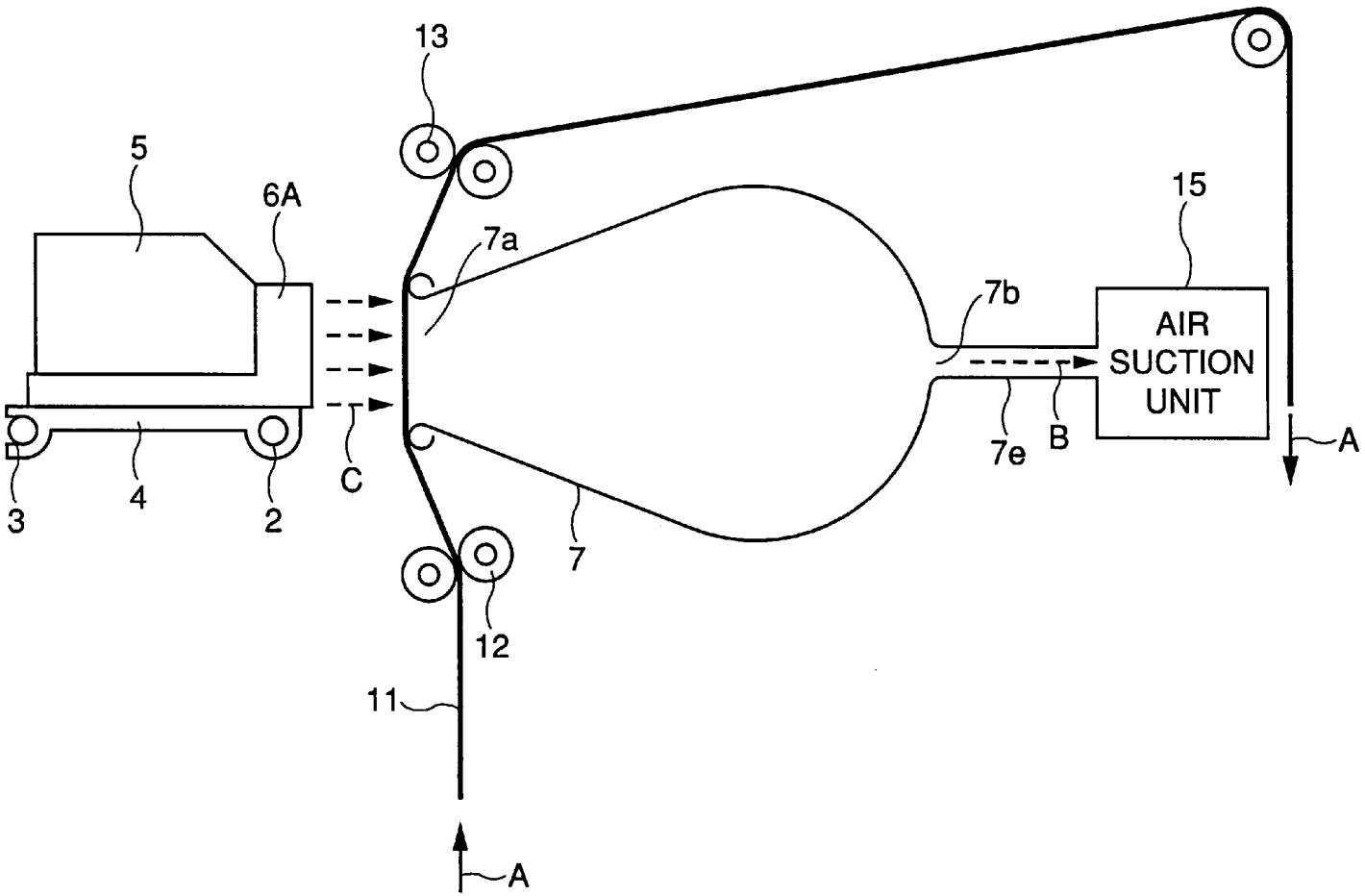
FIG. 15 is a schematic illustration showing a structure of an ink jet dyeing apparatus in accordance with a third embodiment of the present invention.

In the third embodiment, in order to suppress fluff on the surface of cloth 11, air suction in accordance with the first embodiment and air emission in accordance with the second embodiment are simultaneously performed. FIG. 15 is a schematic illustration showing a structure of the ink jet dyeing apparatus in accordance with the third embodiment of the present invention. The ink jet dyeing apparatus of FIG. 15 differs from that of the first embodiment shown in FIG. 1 in that ink jet head 6 is replaced by ink jet head 6A which is capable of emitting air. Except this point, the structure is the same as that of FIG. 1.

In FIG. 15, at opening 7*a* of platen 7, the rear side of cloth 11 is set to negative pressure by air suction in the direction of the arrow B, and at the same time, air is emitted in the direction of the arrow C from ink jet head 6A to the front surface of cloth 11, that is, the surface facing ink jet head 6A, while the cloth 11 is conveyed in the direction of the arrow A. Consequently, fluff 11*a* can be effectively laid down at the surface of cloth 11 while the amount of air emission is reduced than in the second embodiment and the amount of air suction is reduced from that of the first embodiment. Further, since air suction and air emission are performed simultaneously, level difference of cloth 11 at the time of air suction can be reduced. Further, that direction of travel of ink drops D is not hindered by the air flow. Further, since cloth 11 is conveyed pulled by rollers 12 and 13, the surface of cloth 11 at opening 7*a* is kept flat. Mesh 14 may be provided at opening 7*a*. In this case also, the level difference at the surface of cloth 11 at opening 7*a* should preferably be 0.5 mm or smaller, and each opening area of the mesh 14 should preferably be at most 25 $cm^2$.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet dyeing apparatus in which cloth is conveyed with a surface position opposed to an ink jet head by ink jet method for dyeing said cloth by jetting said ink to the surface of said conveyed cloth, comprising fluff suppressing means, by using wind pressure, for suppressing fluff on the surface of said cloth at the time of dyeing.

2. The ink jet dyeing apparatus according to claim 1, wherein said fluff suppressing means includes air suction means for sucking air from behind said cloth opposing to said head, so as to attain negative pressure at a rear surface side of said cloth.

3. The ink jet dyeing apparatus according to claim 2, wherein said fluff suppressing means includes a hollow platen having an opening formed to be in contact with the rear surface of said cloth opposing to said head, and said air suction means and said platen are connected by a path of air flow sucked by air suction means.

4. The ink jet dyeing apparatus according to claim 3, wherein said fluff suppressing means further includes recess formation suppressing means for suppressing formation of a recess at a surface of said cloth at said opening of said platen by air suction of said air suction means.

5. The ink jet dyeing apparatus according to claim 4, further comprising a supply roller for supplying said cloth to a position opposing to said head and a take up roller for taking up said cloth from the position opposing to said head, for conveying said cloth, wherein said recess formation suppressing means allows said cloth to be conveyed stretched tight by said supply roller and said take up roller, while the rear surface of said cloth opposing to said head is in contact with said opening.

6. The ink jet dyeing apparatus according to claim 4, wherein said recess formation suppressing means includes a mesh allowing passage of air and covering said opening of said platen.

7. The ink jet dyeing apparatus according to claim 6, wherein area of each opening of said mesh is at most 25 $cm^2$.

8. The ink jet dyeing apparatus according to claim 6, wherein when air suction by said air suction means from behind said cloth causes a plurality of protrusions and a plurality of recesses at the surface of said cloth in contact with said mesh, height between each of said plurality of recesses to each of said plurality of protrusions is at most 0.5 mm.

9. The ink jet dyeing apparatus according to claim 1, wherein said fluff suppressing means includes air emission means for emitting air from a side of said head to the surface of said cloth opposing to said head.

10. The ink jet dyeing apparatus according to claim 9, wherein said head includes a plurality of orifices for jetting said ink, and said air emission means formed integrally with said head and includes a plurality of air emission openings formed around said plurality of orifices for emitting air.

11. The ink jet dyeing apparatus according to claim 10, wherein each of said plurality of air emission openings is formed within 10 mm from each of said plurality of orifices.

12. The ink jet dyeing apparatus according to claim 11, wherein direction of air emission from each of said plurality of air emission openings is close to direction of jetting said ink from each of said plurality of orifices.

13. The ink jet dyeing apparatus according to claim 10, wherein said plurality of air emission openings emit same and constant amount of air.

14. The ink jet dyeing apparatus according to claim 13, wherein pressure for emitting air at each of said plurality of air emission openings is 1.2 to 3 times the atmospheric pressure.

15. The ink jet dyeing apparatus according to claim 13, wherein said air emission means further includes an air supply inlet from which air is supplied, and an air path having each of said plurality of air emission openings at one end and said air supply inlet at the other end, provided common to said plurality of air emission openings for emitting from said plurality of air emission openings, the air supplied from said air supply inlet, difference in distance between said air supply inlet and each of said plurality of air emission openings in said air path is at most 10 cm.

16. The ink jet dyeing apparatus according to claim 1, wherein said fluff suppressing means includes air suction means for sucking air from behind said cloth to attain negative pressure at a rear surface side of said cloth opposing to said head, and air emission means for emitting air from a side of said head to the surface of said cloth opposing to said head.

17. The ink jet dyeing apparatus according to claim 16, wherein said fluff suppressing means includes a hollow platen having an opening formed to be in contact with the rear surface of said cloth opposing to said head, and said air suction means and said platen are connected through a path of air flow sucked by said air suction means.

18. The ink jet dyeing apparatus according to claim 17, wherein said fluff suppressing means further includes recess formation suppressing means for suppressing formation of a recess at a surface of said cloth at said opening of said platen by air suction by the air suction means or by air emission by said air emission means.

19. The ink jet dyeing apparatus according to claim 18, further comprising a supply roller for feeding said cloth to a position opposing to said head and a take up roller for taking up said cloth from the position opposing to said head, for conveying said cloth, wherein said recess formation suppressing means allows said cloth to be conveyed stretched by said supply roller and said take up roller with the rear surface of said cloth opposing to said head being in contact with said opening.

20. The ink jet dyeing apparatus according to claim 18, wherein said recess formation suppressing means includes a mesh allowing passage of air and covering said opening of said platen.

* * * * *